United States Patent [19]

Jacobson

[11] Patent Number: 5,037,472

[45] Date of Patent: Aug. 6, 1991

[54] COMPARTMENTED INSULATION BLANKET AND METHOD OF USE

[75] Inventor: Robert Jacobson, Elk Grove Village, Ill.

[73] Assignee: W. R. Grace & Co.-Conn., New York, N.Y.

[21] Appl. No.: 591,654

[22] Filed: Oct. 2, 1990

[51] Int. Cl.[5] ..... C21C 5/48

[52] U.S. Cl. ..... 75/709; 266/272

[58] Field of Search ..... 75/709; 266/272

[56] References Cited

U.S. PATENT DOCUMENTS

| | | | |
|---|---|---|---|
| Re. 31,589 | 5/1984 | Phoenix | 75/709 |
| 31,589 | 5/1984 | Phoenix | 75/27 |
| 1,720,286 | 7/1929 | Michel | 75/709 |
| 2,165,945 | 10/1936 | Seaver | 22/216 |
| 2,462,256 | 11/1945 | Charman et al. | 22/147 |
| 3,330,647 | 7/1967 | D'A Hunt | 75/709 |
| 4,033,762 | 7/1977 | Sato | 75/709 |
| 4,066,446 | 1/1978 | Peck | 75/96 |
| 4,297,133 | 10/1981 | Fujii | 75/53 |
| 4,364,770 | 12/1982 | Douchy et al. | 75/53 |
| 4,462,834 | 7/1984 | LaBate | 106/38.28 |
| 4,524,702 | 6/1985 | Miller et al. | 110/173 A |
| 4,577,839 | 3/1986 | Carison et al. | 266/272 |
| 4,600,560 | 7/1986 | Vallak | 422/41 |
| 4,606,473 | 8/1986 | Miller et al. | 220/215 |
| 4,659,679 | 4/1987 | Falk | 501/99 |
| 4,750,717 | 6/1988 | Pheasant et al. | 266/286 |

*Primary Examiner*—Peter D. Rosenberg

*Attorney, Agent, or Firm*—Celia H. Ketley; William L. Baker

[57] ABSTRACT

An insulating blanket is provided for dispensing an insulating particulate material onto the surface of a molten metal. This blanket comprises a bag containing the insulating particulate material, the bag having flattening means such that when the bag is filled with the particulate material, it maintains a substantially flat shape. The bag is formed of a material which will disintegrate upon contact with the molten metal, thereby allowing the particulate material to spread over the surface thereof.

25 Claims, 1 Drawing Sheet

COMPARTMENTED INSULATION BLANKET AND METHOD OF USE

BACKGROUND OF THE INVENTION

The present invention relates to a blanket for dispensing an insulating particulate material onto the surface of a molten metal and to a method of using the blanket.

In the past, particulate materials have been applied to the surface of molten metals, e.g., in ladles and tundishes, in order to protect the molten metal from oxidation and provide heat insulation, thereby preventing the formation of a "skin" on the metal surface. Typically, it has been the practice to shovel loose or bulk material onto the surface of the metal to be insulated. A variety of particulate materials have been used in this manner, e.g., vermiculite, perlite, and rice hull ash.

This practice presents several disadvantages. When the particulate material is applied to the surface of the molten metal in a ladle, a great deal of dust may be generated and material is often spilled and wasted. Further, particulate material which is packaged in bulk is cumbersome and difficult to transport, store and dispense.

These difficulties have been somewhat alleviated by the practice of throwing bags of the particulate material onto the surface of the molten metal. These bags are typically of plastic or paper and thus decompose when they contact the molten metal. This practice tends to be uneconomical however, as the particulate material, rather than spreading out, tends to stay in a small area of the molten surface forming clumps of excess material. Thus it is necessary to use a large number of bags in order to adequately cover the entire molten surface. These bags of particulate material are also relatively difficult to store and transport using conventional methods, e.g., pallets.

Thus it has been desired to provide a means of dispensing an even layer of insulating particulate material onto the surface of molten metals without the above mentioned disadvantages.

SUMMARY OF THE INVENTION

The present invention provides a blanket for dispensing an insulating particulate material onto the surface of a molten metal. This blanket comprises a bag containing an insulating particulate material, the bag having flattening means such that when the bag is filled with the particulate material, it maintains a substantially flat shape. The bag is formed of a material which will disintegrate upon contact with the molten metal, allowing the particulate material to spread over the surface thereof.

The blanket of the invention overcomes the difficulties of the prior art by containing the particulate material in a convenient amount so that it can be applied to the molten metal without waste. In addition, dust generation is minimized or eliminated. The flat shape of the blanket provides a large surface area in contact with the metal, so that as the bag disintegrates, the particulate material spreads to form an even layer on the molten surface, without any clumps of excess material. Additionally, the flat blankets are easy and convenient to transport and store using conventional methods, i.e., pallets/forklifts.

DETAILED DESCRIPTION OF THE INVENTION

Figure 1:
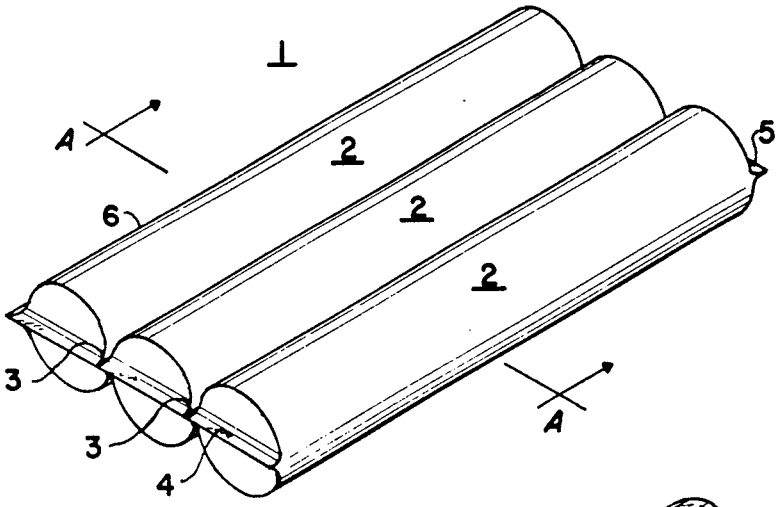
FIG. 1 is a perspective view of a blanket according to one embodiment of the invention.

FIG. 1 illustrates a preferred embodiment of the insulating blanket of the invention. The blanket 1 comprises bag 6, which comprises top and bottom layers 12 and 13, respectively, and is separated into three separate compartments 2 by a pair of lengthwise seals 3. The bag is sealed at one end, prior to filling, by width-wise seal 4, and at the other end, subsequent to filling by width-wise seal 5.

While the blanket shown in FIG. 1 has three compartments, a bag according to the invention could have any number of compartments. It is only essential that the compartments serve to maintain the bag in a substantially flat shape, i.e., that the average thickness of the blanket be substantially less than the surface area of same. It is generally preferred that the ratio of surface area to thickness be on the order of at least 100:1 for expanded fillers, and 200:1 for unexpanded fillers.

The bag 6 may be of any material which will disintegrate when exposed to molten metal, e.g., plastic, paper or cloth. Plastic is preferred, as it can be easily and economically heat sealed at spaced intervals to form the lengthwise seals 3. However, if it is desired to use other materials, such as paper, compartments 2 can be formed by rows of stitching (analogous to the lengthwise seals 3). Other conventional sealing/seaming methods may be used, provided the separate, flattening, compartments of the invention are obtained.

Figure 2:
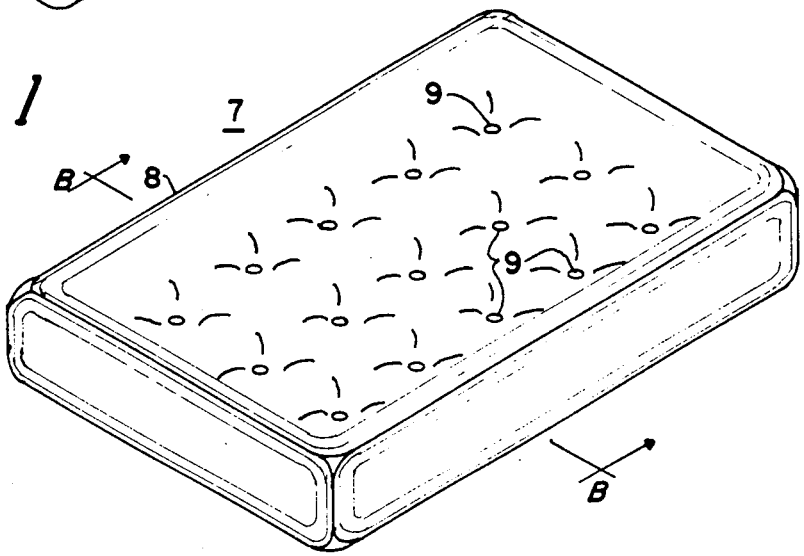
FIG. 2 is a perspective view of a blanket according to another embodiment of the invention.

An insulating blanket 7 according to a second embodiment of the invention is shown in FIG. 2. In this embodiment the bag 8 is flattened by means of a plurality of tufts 9. Again, the bag may be formed of any material which will disintegrate when in contact with molten metal, and the tufts may be formed by sealing discrete areas of the bag by heat sealing, stitching, or other conventional sealing methods as appropriate.

The blanket shown in FIG. 2 has tufts which are arranged in rows. This configuration may, as a practical matter, be easiest to manufacture. However, any desired configuration or random orientation of tufts may be used, provided the bag maintains its substantially flat shape when filled, and provided that it is possible to fill the bag with the particulate material.

Figure 3:
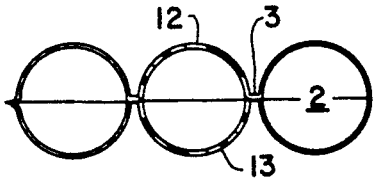
FIG. 3 is a cross-sectional view, taken across line A—A in FIG. 1.
Figure 4:
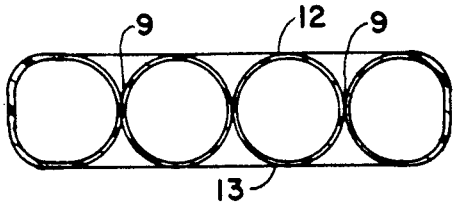
FIG. 4 is a cross-section view, taken across line B—B line FIG. 2.

FIGS. 3 and 4 show cross-sectional views of the blankets shown in FIGS. 1 and 2, taken across the sealed areas (i.e., across lines A—A and B—B, respectively). In these two figures, it is seen that the top and bottom layers 12 and 13 of the bag are completely sealed together at areas 3 and 9, respectively. While it is necessary to completely seal layers 12 and 13 if heat-sealing is used, it may not be necessary if an alternate method such as stitching is utilized (i.e., the stitching would only need only be tight enough to maintain the flat configuration of the bag.

The blanket of the invention may be filled with any particulate material which will effectively insulate the surface of the molten metal. Insulating materials include vermiculite, perlite and rice hull ash, with vermiculite being the preferred material. Either expanded or unexpanded vermiculite may be used. (If unexpanded vermiculite is used, it will expand in situ upon contact with the molten metal). Unexpanded vermiculite may be preferred due to its lower cost relative to expanded vermiculite. The blanket of the invention may also contain additional particulate materials which produce other desirable effects on the metal such as promoting spreadability or reacting exothermically to add heat to the metal. Such materials include wood flour, which promotes spreadability, and aluminum dross, which reacts exothermically with the metal. The particulate material may also comprise mixtures of the above materials.

The bag is typically filled with the particulate material, to form the blanket of the invention, subsequent to the formation of the separate compartments or tufts. The bag may be filled using any conventional means. A preferred means for the type of bag shown in FIG. 1 is a spout having separate nozzles for each compartment of the bag.

The blanket of the invention may be of any convenient size. The desired size may depend on such factors as the size of the ladle or tundish in which the molten metal is contained, and storage/transport considerations. The blanket of the invention may also be of any desired shape, e.g., circular rather than rectangular, provided that it is substantially flat.

In its method aspects, the present invention relates to a process for insulating the surface of a molten metal comprising the steps of providing one or more insulating blankets of the invention and placing these blankets onto the surface of the molten metal in a configuration such that, as each bag disintegrates, the particulate material contained therein will spread out to substantially completely cover the surface of the molten metal.

The number of blankets used in this process will depend upon the size of each blanket and the size of the ladle or tundish which contains the molten metal. Preferably the blankets should be arranged on the molten surface in such a manner that the particulate material will spread to just cover the molten surface, without any excess. This result is typically obtained by spacing the blankets such that, prior to disintegration, the blanket cover is from about 70 to 80 percent of the surface area of the molten metal.

The above figures and description illustrate preferred embodiments of the invention. Other variations and modifications which are within the spirit and scope of the invention may be made by those skilled in the art.

What is claimed is:

1. A blanket for dispensing an insulating particulate material onto the surface of a molten metal comprising a bag containing an insulating particulate material, said bag having flattening means such that when the bag is filled with the particulate material it maintains a substantially flat shape, and being formed of a material which will disintegrate upon contact with the molten metal, allowing the particulate material to spread over the surface thereof.

2. The blanket of claim 1 wherein the flattening means comprises a plurality of separate compartments in the bag.

3. The blanket of claim 2 wherein the separate compartments are formed by heat sealing the bag at spaced intervals.

4. The blanket of claim 2 wherein the separate compartments are formed by stitching the bag at spaced intervals.

5. The blanket of claim 1 wherein the flattening means comprises a plurality of tufts.

6. The blanket of claim 5 wherein the tufts are formed by heat sealing discrete areas of the bag at spaced intervals.

7. The blanket of claim 5 wherein the tufts are formed by stitching discrete areas of the bag at spaced intervals.

8. The blanket of claim 1 wherein the bag is formed of a plastic.

9. The blanket of claim 1 wherein the bag is formed of paper.

10. The blanket of claim 1 wherein the particulate material is expanded vermiculite.

11. The blanket of claim 1 wherein the particulate material is perlite.

12. The blanket of claim 1 wherein the particulate material is rice hull ash.

13. A process for insulating the surface of a molten metal comprising the steps of:

a) providing one or more insulating blankets comprising a bag containing an insulating particulate material, said bag having flattening means such that when the bag is filled with the particulate material it maintains a substantially flat shape, and being formed of a material which will disintegrate upon contact with the molten metal, allowing the particulate material to spread over the surface thereof; and b) placing the blankets onto the surface of the molten metal in a configuration such that as each bag disintegrates the particulate material contained therein will spread out to substantially completely cover the surface of the molten metal.

14. The process of claim 13 wherein the flattening means comprises a plurality of separate compartments in the bag.

15. The process of claim 14 wherein the separate compartments are formed by heat sealing the bag at spaced intervals.

16. The process of claim 14 wherein the separate compartments are formed by stitching the bag at spaced intervals.

17. The process of claim 13 wherein the flattening means comprises a plurality of tufts.

18. The process of claim 17 wherein the tufts are formed by heat sealing discrete areas of the bag at spaced intervals.

19. The process of claim 17 wherein the tufts are formed by stitching discrete areas of the bag at spaced intervals.

20. The process of claim 13 wherein the bag is formed of a plastic.

21. The process of claim 13 wherein the bag is formed of paper.

22. The process of claim 13 wherein the particulate material is expanded vermiculite.

23. The process of claim 13 wherein the particulate material is perlite.

24. The process of claim 13 wherein the particulate material is rice hull ash.

25. The process of claim 13 wherein the blankets are spaced apart such that, prior to disintegration, the blankets cover from about 70 to 80 percent of the surface area of the molten metal.

* * * * *